US009346576B2

(12) United States Patent
Allgaier et al.

(10) Patent No.: US 9,346,576 B2
(45) Date of Patent: May 24, 2016

(54) TRAY SEALER AND METHOD OF CONVEYING TRAYS

(71) Applicant: Multivac Sepp Haggenmüller GmbH & Co. KG, Wolfertschwenden (DE)

(72) Inventors: Alois Allgaier, Nesselwang (DE); Claus Botzenhardt, Kempten (DE)

(73) Assignee: MULTIVAC SEPP HAGGENMUELLER SE & CO. KG, Wolfertschwenden (DE)

( * ) Notice: Subject to any disclaimer, the term of this patent is extended or adjusted under 35 U.S.C. 154(b) by 561 days.

(21) Appl. No.: 13/781,910

(22) Filed: Mar. 1, 2013

(65) Prior Publication Data

US 2013/0227914 A1 Sep. 5, 2013

(30) Foreign Application Priority Data

Mar. 2, 2012 (DE) ..... 10 2012 004 372

(51) Int. Cl.

| | |
|---|---|
| ***B65B 35/00*** | (2006.01) |
| ***B65B 7/16*** | (2006.01) |
| ***B65B 57/04*** | (2006.01) |
| ***B65B 43/52*** | (2006.01) |

(52) U.S. Cl.

CPC ..... *B65B 35/00* (2013.01); *B65B 7/164* (2013.01); *B65B 43/52* (2013.01); *B65B 57/04* (2013.01)

(58) Field of Classification Search

CPC ..... B65B 43/48–43/62; B65B 57/04; B65B 57/08; B65B 7/164; B65G 54/02; B65G 35/00–35/08; B65G 54/025; B65G 21/2009; B65G 21/2018; B65G 23/23; B65G 25/00–25/12; B65G 2203/043; B65G 2207/36; B65G 47/844; B65G 47/845; G05B 19/042

USPC ..... 198/619, 805; 310/12.09, 12.11; 53/432, 434, 285

See application file for complete search history.

(56) References Cited

U.S. PATENT DOCUMENTS

| | | | | |
|---|---|---|---|---|
| 2,615,377 | A * | 10/1952 | Farrell | B31B 17/00 493/95 |
| 3,908,342 | A * | 9/1975 | Raque | 53/329.4 |
| 4,936,072 | A * | 6/1990 | Creed | B65B 7/2878 198/339.1 |
| 5,385,003 | A * | 1/1995 | Nixon et al. | 53/471 |
| 5,724,785 | A * | 3/1998 | Malanowski | B65B 21/24 198/728 |
| 6,425,474 | B2 * | 7/2002 | Spatafora | 198/346.2 |
| 6,876,107 | B2 * | 4/2005 | Jacobs | 310/12.19 |
| 6,876,896 | B1 * | 4/2005 | Ortiz et al. | 700/112 |
| 7,134,258 | B2 * | 11/2006 | Kalany et al. | 53/473 |
| 7,597,187 | B2 * | 10/2009 | Bausenwein et al. | 198/619 |

(Continued)

FOREIGN PATENT DOCUMENTS

| | | |
|---|---|---|
| DE | 3209595 A1 | 10/1983 |
| DE | 69003503 T2 | 3/1994 |

(Continued)

*Primary Examiner* — Stephen F Gerrity
*Assistant Examiner* — Joshua Kotis
(74) *Attorney, Agent, or Firm* — Husch Blackwell LLP

(57) ABSTRACT

The invention relates to a tray sealer comprising a sealing station for sealing trays with a cover film, and a conveyor system for conveying the trays along a conveying path, wherein the conveyor system includes a plurality of pushers each configured for carrying along at least one tray and movable along an endless pusher path. The invention is characterized in that the pushers are movable independently of one another along the pusher path.

18 Claims, 3 Drawing Sheets

(56) References Cited

U.S. PATENT DOCUMENTS

| | | | | |
|---|---|---|---|---|
| 7,815,034 | B2 * | 10/2010 | Fleck et al. | 198/437 |
| 2005/0256774 | A1 * | 11/2005 | Clothier et al. | 705/15 |
| 2005/0274092 | A1 * | 12/2005 | Rohret | B65B 7/2814 53/478 |
| 2008/0128245 | A1 * | 6/2008 | Arthaud | 198/419.3 |
| 2009/0301658 | A1 * | 12/2009 | Vine et al. | 156/497 |
| 2010/0084247 | A1 * | 4/2010 | Wipf et al. | 198/617 |
| 2011/0072764 | A1 * | 3/2011 | Daniek et al. | 53/556 |
| 2012/0013138 | A1 * | 1/2012 | Ickert | 294/24 |
| 2012/0090963 | A1 * | 4/2012 | van de Loecht et al. | 198/805 |
| 2012/0139559 | A1 * | 6/2012 | van de Loecht | 324/654 |
| 2013/0037384 | A1 * | 2/2013 | Reinisch | 198/464.2 |
| 2013/0152516 | A1 * | 6/2013 | Sammons | B65B 9/087 53/562 |

FOREIGN PATENT DOCUMENTS

| | | | | |
|---|---|---|---|---|
| DE | 102004023473 | A1 | 12/2005 | |
| DE | 102004042474 | A1 | 3/2006 | |
| DE | 102007014876 | A1 | 10/2008 | |
| DE | 102008040204 | A1 | 1/2010 | |
| DE | 102009002606 | A1 | 10/2010 | |
| DE | 102009003080 | A1 | 11/2010 | |
| DE | 102010028333 | A1 | 11/2011 | |
| DE | 102010027211 | A1 | 1/2012 | |
| EP | 0496046 | A1 * | 7/1992 | B65G 17/002 |
| EP | 0813494 | A1 | 12/1997 | |
| EP | 0909728 | A1 * | 4/1999 | |
| EP | 1123886 | A1 * | 8/2001 | |
| WO | 0048908 | A1 | 8/2000 | |
| WO | 2011080514 | A2 | 7/2011 | |
| WO | WO 2011080514 | A2 * | 7/2011 | |

* cited by examiner

TRAY SEALER AND METHOD OF CONVEYING TRAYS

CROSS-REFERENCE TO RELATED APPLICATIONS

This application claims priority to German Application Number 102012004372.4 filed Mar. 2, 2012, to Alois Allgaier and Claus Botzenhardt entitled "Tray Sealer and Method of Conveying Trays," currently pending, the entire disclosure of which is incorporated herein by reference.

FIELD OF THE INVENTION

The invention relates to a tray sealer comprising a sealing station as well as to a method of conveying trays by means of a conveyor system up to, into and/or from a tray sealer sealing the trays with a cover film.

BACKGROUND OF THE INVENTION

In the case of tray sealers known in practice, trays are normally conveyed by means of a conveyor system up to a sealing station. In said sealing station, the trays, which were previously filled with a product, are sealed by means of a cover film and closed in this way. If necessary, the trays may previously be evacuated and/or flushed with a replacement gas or a gas mixture. For transferring the trays from a feed belt into the sealing station, a gripper system is often used, this kind of gripper system being disclosed e.g. by DE 10 2010 027 211.6.

In the case of a different type of tray sealers of the type in question, the trays are positioned on a conveying path where they are taken hold of and advanced by pushers. These pushers are often crossbars extending transversely across the conveying path and having both their ends fixed in a conveyor chain. Thus, they are inevitably spaced at constant distances from one another, the respective distance being larger than the length of a tray in the conveying direction.

Circulating transfer systems used for conveying products, but not adapted for use in a tray sealer, are known from WO 00/48908 A1, DE 10 2009 003 080 A1 or DE 10 2010 028 333 A1.

SUMMARY OF THE INVENTION

It is the object of the present invention to improve a tray sealer and a method of conveying trays with respect to their efficiency.

The tray sealer according to one embodiment of the present invention is characterized in that the pushers configured for carrying along at least one tray are movable independently of one another along the pusher path. In other words, it is no longer required that two arbitrary pushers must be spaced apart at a constant distance and move at identical speeds. On the contrary, the distances between and speeds of arbitrary pushers, and in particular also neighboring pushers, may deviate from one another. Surprisingly enough, this leads to a substantial increase in the efficiency of the tray sealer, since this allows, even without the use of intricately synchronized conveyor belts, for example, a variation of the distances between the trays along their conveying path so as to adapt these distances to demands varying along the conveying path. For example, the trays may be moved at a lower speed along a filling line, so that they can be filled more easily, whereas the speed at which they can be conveyed to a sealing station may be high. There, the variable distances between neighboring pushers allow the distances between the individual trays to adapt to the dimensions of a sealing tool in a particularly effective manner.

According to a comparatively simple variant, the speed profiles of the various pushers are identical along the pusher path, even if different pushers are located at different points of their speed profiles at any time. According to a more elegant embodiment, each pusher can, however, be moved along the pusher path with an individual speed profile so as to improve the flexibility of use of the tray sealer still further. Hence, the conveyor system of the tray sealer may be able to react to irregularly arriving trays and it may even be able to form a regular arrangement of trays from trays that arrived irregularly.

Normally, the pusher path will comprise a conveying section, associated with the conveying path for the trays, and a return section. It will be of advantage when the pushers are movable on the return section at a speed, or at least an average speed, which is higher than the speed at which they move on the conveying section. It is thus possible to return the pushers, which are free after having conveyed a tray, quickly to the starting point of the conveying section so that the total number of pushers required will be reduced.

In one embodiment, at least one linear motor used for driving the pushers is provided along the pusher path. It is provided with a sequence of electromagnets arranged along the endless closed pusher path. The pusher itself, or a slide on which the pusher is secured in position, serves as a runner of the linear motor and is adapted to be moved along the path of the linear motor by varying magnetic fields. In order to establish a distance between the windings of the electromagnets and the runner, wheels, air cushions or some electromagnetically generated hovering effect may be used.

It is imaginable that at least one position sensor is provided for detecting the position of a tray and/or the position of a pusher. Such a position sensor increases the efficiency of the tray sealer still further. By means of the signal of the position sensor it can be guaranteed that a tray will reliably be taken hold of by a pusher and that even in the case of irregularly arriving trays, a respective pusher will be available at an adequate moment in time.

According to one embodiment of the present invention, a buffer section for buffering a plurality of trays may be provided along the conveying path. Such a buffer section is characterized in that the average speed of the trays therein may be lower and/or the distances between the individual trays may be smaller. Making use of the buffer section, subsequent stations, such as the sealing station of the tray sealer, can have supplied thereto a stream of trays which is as uniform as possible so as to guarantee a uniform operation of the tray sealer.

The conveyor system may also comprise not only one, but two, three or quite generally a plurality of tracks for conveying a plurality of juxtaposed tracks of trays. In comparison with a single-track embodiment of the tray sealer, this will increase the throughput, i.e., the number of trays that can be conveyed per unit time along a specific path section.

When the conveyor system comprises a plurality of tracks, the pushers of different tracks may be adapted to be moved independently of one another. Thus, also trays arriving irregularly on neighboring tracks can be taken hold of and advanced.

According to a further embodiment, juxtaposed pushers of different tracks may be adapted to be coupled with respect to their speeds in certain sections along the conveying path. This speed coupling may especially be effected when the pushers have assumed precisely the same position along the conveying path, so that the trays grasped thereby are positioned accurately side by side. This allows a particularly effective processing of the trays, e.g., by means of a sealing tool.

In addition, at least some of the pushers, or even all the pushers, may be mounted on a respective slide, which is movable along the pusher path, such that they are adapted to be moved relative to said slide. The pushers can thus be removed from the area of the sealing tools closing around a tray, so that the sealing tools will be able to form a hermetically-closed sealing chamber without any interference on the part of the pusher.

The pusher may, for example, be provided on the slide such that it is pivotable and/or translationally movable. It may, for example, be simply movable outwards horizontally and transversely to the conveying direction of the trays. It would also be possible to provide the pusher with a variable length, for example, with a telescopic structural design, for this purpose.

The invention also relates to a method of conveying trays by means of a conveyor system. According to the invention, this method is conceived so that the pushers may be moved independently of one another along a pusher path of the conveyor system so as to provide the above-described advantages.

It has already been explained that the pushers may be moved such that their speed along a return section of the conveyor system is higher than their speed along a conveying section of the conveyor system, and that, if desired, the trays may be conveyed along the conveying path not only on one track but on a plurality of juxtaposed tracks. Normally, these tracks will extend parallel to one another. In particular, juxtaposed pushers of different tracks may be moved at the same speed in certain sections along the conveying path.

According to one embodiment of the method, at least some of the pushers are mounted on a respective slide, which is movable along the pusher path, such that they are adapted to be moved relative to said slide, and that, prior to closing a sealing tool, they can be removed from the area of said sealing tool.

Other and further objects of the invention, together with the features of novelty appurtenant thereto, will appear in the course of the following description.

DESCRIPTION OF THE SEVERAL VIEWS OF THE DRAWING

In the accompanying drawing, which forms a part of the specification and is to be read in conjunction therewith in which like reference numerals are used to indicate like or similar parts in the various views.

Identical components are designated by identical reference numerals throughout the figures.

DETAILED DESCRIPTION OF THE INVENTION

Figure 1:
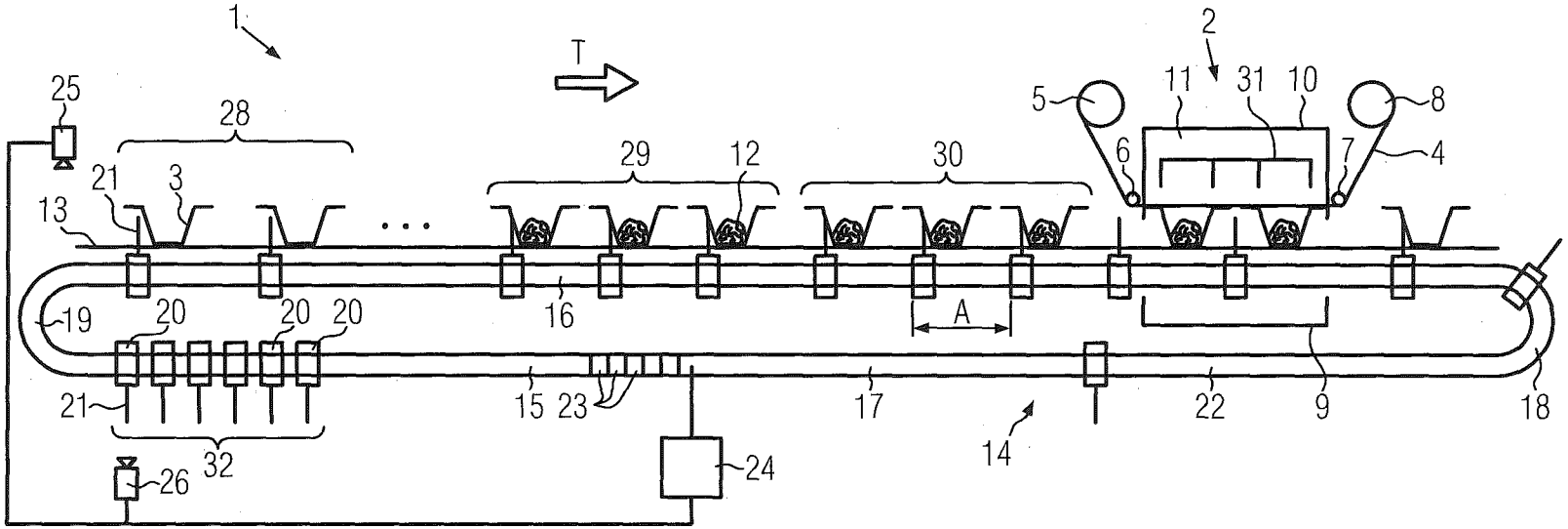
FIG. 1 is a schematic representation of a tray sealer in accordance with one embodiment of the present invention.

The invention will now be described with reference to the drawing figures, in which like reference numerals refer to like parts throughout. For purposes of clarity in illustrating the characteristics of the present invention, proportional relationships of the elements have not necessarily been maintained in the drawing figures.

The following detailed description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

FIG. 1 shows a schematic view of a tray sealer 1 according to one embodiment of the present invention, including a sealing station 2 in which trays 3, in particular plastic trays, can be closed with a cover film 4. The cover film 4 may be unwound from a film roll 5 and guided via a deflection pulley 6 into the sealing station 2. On the other side of the sealing station 2, an additional deflection pulley 7 guides the residual film grid of the cover film 4 onto a residual film winder 8.

The sealing station 2 comprises, as is normally the case, a lower tool 9 and an upper tool 10. These tools 9, 10 of the sealing station 2 are shown in FIG. 1 at the open position. They can, however, be transferred to a closed position, where they define between them a hermetically sealed sealing chamber 11 in which the trays 3 filled with a product 12 can be evacuated and/or flushed with gas before they are sealed.

The tray sealer 1 is provided with a conveying path 13 along which the trays 3 are conveyed in a conveying direction T to the sealing station 2, through the sealing station 2 and away from the sealing station 2. The conveying path 13 may be configured in the form of a support or a sliding plane on which the trays 3 rest. In particular, it would be imaginable that the conveying path 13 configured as a support includes a slit or an interruption so that a conveyor system 14 arranged below the conveying path 13 will be able to take hold of the trays 3 and convey them along the conveying path 13.

Alternatively, the conveyor system 14 may laterally encompass the conveying path 13.

The conveyor system 14 can comprise an endless pusher path 15. This pusher path 15, in turn, includes a first, straight conveying section 16 associated with the conveying path 13 and located directly below said conveying path 13, as well as a return section 17 which may be straight as well and which is located below or alongside the conveying section 16, and two curved connecting sections 18, 19 that interconnect the two above-mentioned sections 16, 17. The pusher path 15 has provided thereon a finite number of slides 20 that are movable along the pusher path 15. Each slide 20 is provided with a pusher 21, which is implemented for carrying along at least one tray 3 and which, to this end, extends from below through a slit in the conveying path 13 in the case of the present embodiment, so that the pusher portion projecting upwards beyond the conveying path 13 will be able to take hold of and carry along a tray 3. To this end, the pusher 21 may be configured, for example, as a rod, plate or bracket.

In order to move the slides 20 and consequently the pushers 21, the pusher path 15 in its entirety can be configured as a linear motor 22. The pusher path 15 thus defines the stationary part of the linear motor 22 whose movable part or runner is defined by the slides 20. The pusher path 15 can be subdivided into fine sections 23, which, for the sake of clarity, are only shown in a short area. Making use of a suitably programmed or programmable control unit 24, a variable magnetic field can be applied to the individual sections 23 such that this magnetic field will move the slides 20 along the pusher path 15. In the course of this process, the slides 20 and pushers 21 located on the conveying section 16 move in the conveying direction T of the trays, whereas on the return section 17 they move in the opposite direction.

The sections 23 of the linear motor 22 are configured such that they are controllable individually by means of the control unit 24. The invention thus allows the individual pushers 21 to move independently of one another, and in particular independently of the respective neighboring slides and pushers 21, along the pusher path 15. It is thus even possible to impart to each pusher 21 along the pusher path 15 its own, individual speed profile.

Position sensors 25, 26, for example, in the form of light barriers or cameras, serve to detect a position of a tray 3 or a pusher 21. A first position sensor 25 can be arranged at the beginning of the conveying path 13 so as to detect there the position and the presence of a tray 3. The position sensor 25 may be located above, below or beside the conveying path 13. A second position sensor 26 can be arranged at the end of the return section 17 of the pusher path 15 so as to detect there the presence and the position of a slide 20 with a pusher 21 and/or the condition of and in particular possible defects of the pusher 21. The data acquired by the position sensors 25, 26 are transmitted via data lines 27 in the form of signals to the control unit 24. Independently of these position sensors 25, 26, the conveyor system 14 may include a position detection system of its own for real time detection of the position of each individual slide 20.

In the following, one embodiment of the method according to the present invention and the operation of the tray sealer 1 will be explained.

In a feed area 28 of the conveying path 13, trays 3 are made available to the conveyor system 14, for example, manually or by a destacker. The arrangement of the trays 3 may be irregular in the feed area 28. The position of each individual tray 3 is detected by the position sensor 25 and transmitted to the control unit 24. By adequately controlling the linear motor 22 of the pusher path 15, the control unit 24 guarantees that a slide 20 with a pusher 21 is provided for each tray 3. This pusher 21 takes hold of the respective tray 3 and ensures transport of the tray 3 along the conveying path 13.

The empty trays 3 travel along the conveying path 13 and arrive at a filling line 29. Along the filling line 29, the trays 3 are filled with a product 12. This filling can be carried out automatically or manually. The individual control of the pushers 21 allows said pushers 21 and the trays 3 grasped thereby to arrive at the filling line 29 equidistantly, even if they were originally fed in an irregular arrangement.

In addition, the pushers 21 are controlled such that the trays 3 are very closely spaced along the filling line 29. It is thus less likely that a product will drop between the trays 3 onto the conveying path 13. Moreover, the trays 3 can be filled more easily due to the small distances between the trays 3. To this end, the filling line 29 may be configured as a buffer section of the conveying path 13, which is configured for buffering a variable number of trays 3. The buffer section may, however, also be implemented separately from the filling line 29. Along the filling line 29, the speed of the slides 20 and, consequently, of the pushers 21 and of the trays 3 is reduced.

In a subsequent section 30 of the conveying path 13, the trays 3 can be reaccelerated to a higher speed and positioned such that they are spaced apart at mutual distances A corresponding to the distances between the trays 3 in a sealing tool 31 of the sealing station 2. The speed of the pushers 21 and of the trays 3 along section 30 can be controlled precisely such that a suitable group of trays 3 will arrive in the sealing station 2 immediately after the opening of the lower and upper tools 9, 10 of the sealing station 2.

In the sealing station 2, the slides 20 and, consequently, the trays 3 are stopped. If necessary, slides 20 are moved back and out of the sealing station 2 or the pushers 21 are removed from the area of the sealing station 2. The lower and upper tools 9, 10 of the sealing station 2 close. The sealing chamber 11 is evacuated and, if desired, flushed with gas before the sealing tool 31 seals the cover film 4 onto the trays 3. After opening of the sealing station 2, the sealed trays 3 are conveyed out of the sealing station 2 and transported away. The slides 20 and pushers 21, which are no longer occupied by the trays 3, are accelerated and advanced along the return section 17 up to the end of the return section 17 at a speed exceeding the speed on the conveying section 16. At the end of the return section 17, the free, available pushers 21 accumulate in an accumulation area 32. The position of the foremost pusher 21 is monitored by means of the position sensor 26. As soon as the position sensor 25 emits a respective signal, the foremost pusher 21 is accelerated via the connecting section 19 so as to take hold of a new tray 3.

Figure 2:
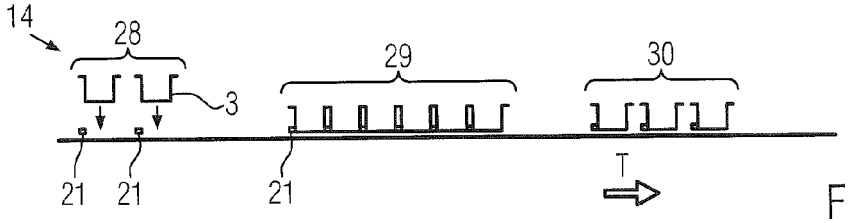
FIGS. 2-5, 6*a*, 6*b* and 6*c* are schematic representations of various embodiments of a conveyor system for the tray sealer in accordance with the present invention.

FIG. 2 shows the embodiment according to FIG. 1 in a more abstract form. In the feed area 28, the empty trays 3 are placed onto the conveying path 13 where they are grasped by free pushers 21. On the buffer section 29, the distances between neighboring trays 3 are minimized, so that the highest number of trays 3 can be buffered thereon along the shortest possible path. On the subsequent grouping section 30, the trays 3 are accelerated and the distances between them are adapted to the dimensions of the sealing tool 31.

Figure 3:
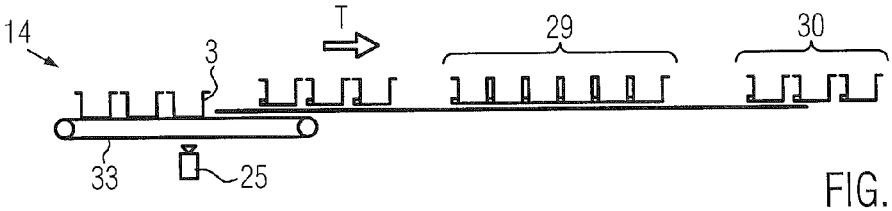

FIG. 3 shows, again in an abstract form, a variant of the conveyor system 14. It differs from the first embodiment insofar as, in the feed area 28, the trays 3 are transferred from an upstream conveyor belt 33 to the conveying path 13. The position sensor 25 detects the position of the respective trays 3 which may perhaps arrive irregularly.

Figure 4:
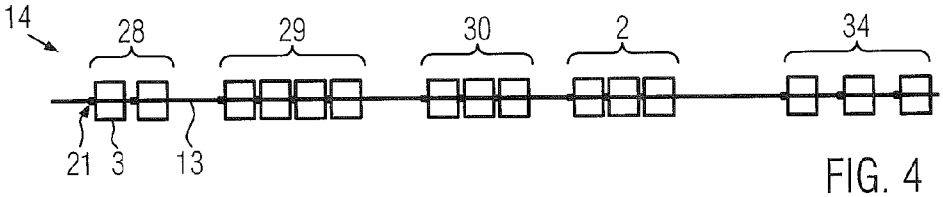

FIG. 4 shows, again in an abstract representation, a further variant of the conveyor system 14, the representation shown in FIG. 4 being, however, a top view. In the feed area 28, the trays 3 are placed onto the conveying path 13 where they are taken hold of by the pushers 21. In the buffer section 29, the trays 3 are buffered and, if desired, they may also be filled there. In the grouping section 30, the distances between the trays 3 may be increased. In the embodiment illustrated in FIG. 4, groups are there formed, said groups comprising each three trays which are fed to the sealing station 2 in common as a group. The sealing station 2 is configured such that a respective group of trays 3, in the present example a group of three trays 3, can be sealed in common therein. On the other side of the sealing station 2, the conveying path 13 includes a separating section 34. By controlling the individual pushers 21 in a suitable way, the distances between neighbouring trays 3 are enlarged on the separating section 34 so as to separate the trays from one another. This facilitates a removal of the individual filled and sealed trays 3 as well as individual process steps such as weighing, checking and/or labeling of the finished trays 3.

Figure 5:
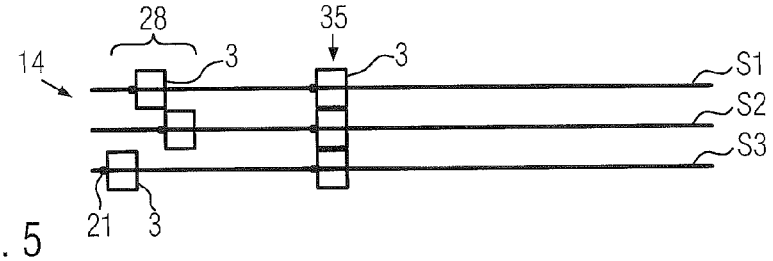

FIG. 5 shows, again in a top view and again in abstract form, a further embodiment of the conveyor system 14. In this case, the conveyor system comprises along the conveying path 13 three juxtaposed tracks S1, S2, S3. Trays 3 can be conveyed on each of the parallel tracks S1, S2, S3. To this end, a separate pusher path 15 comprising, in correspondence with FIG. 1, separate pushers 21 is provided below each of the three tracks S1 to S3.

The trays 3 need not necessarily be fed in a regular mode along the feed area 28. Thanks to the individually controlled pushers 21 it is nevertheless possible to move the trays 3 on the individual tracks S1 to S3 such that, from a position 35 onwards, trays 3 will be juxtaposed directly and on the same level on all three tracks S1 to S3.

Figure 6A:
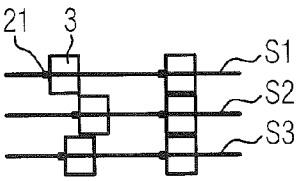
Figure 6B:
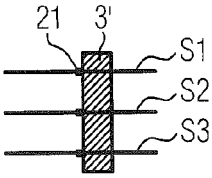
Figure 6C:
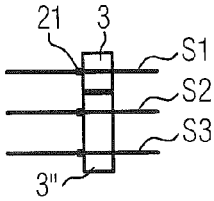

FIGS. 6*a* to 6*c* show different operating variants obtained with a multi-track conveyor system 14. FIG. 6*a* corresponds to the situation which has already been described on the basis of FIG. 5 and in the case of which an irregular arrangement of trays 3 along the three tracks S1 to S3 is converted into a regular arrangement of trays 3 that are juxtaposed directly and on the same level, each of the three tracks S1, S2, S3 having provided thereon a respective tray 3.

In FIG. 6*b*, a larger tray 3', which extends across all three tracks S1 to S3 in the transverse direction, is conveyed along the conveying path 13. In the case of such broad trays 3' it may possibly suffice when the tray 3' is only acted upon by two of the pushers 21 on the three tracks S1 to S3.

FIG. 6*c* shows a further variant. According to this variant, a tray 3 having the same dimensions as originally described is conveyed along the first track S1. A further tray 3" is, however, broader and is conveyed on the two other tracks S2, S3. Provided that the tray 3" is sufficiently stabilized, it will suffice when the broader tray 3" is only acted upon by one of the two pushers 21 of the two tracks S2, S3.

Figure 7:
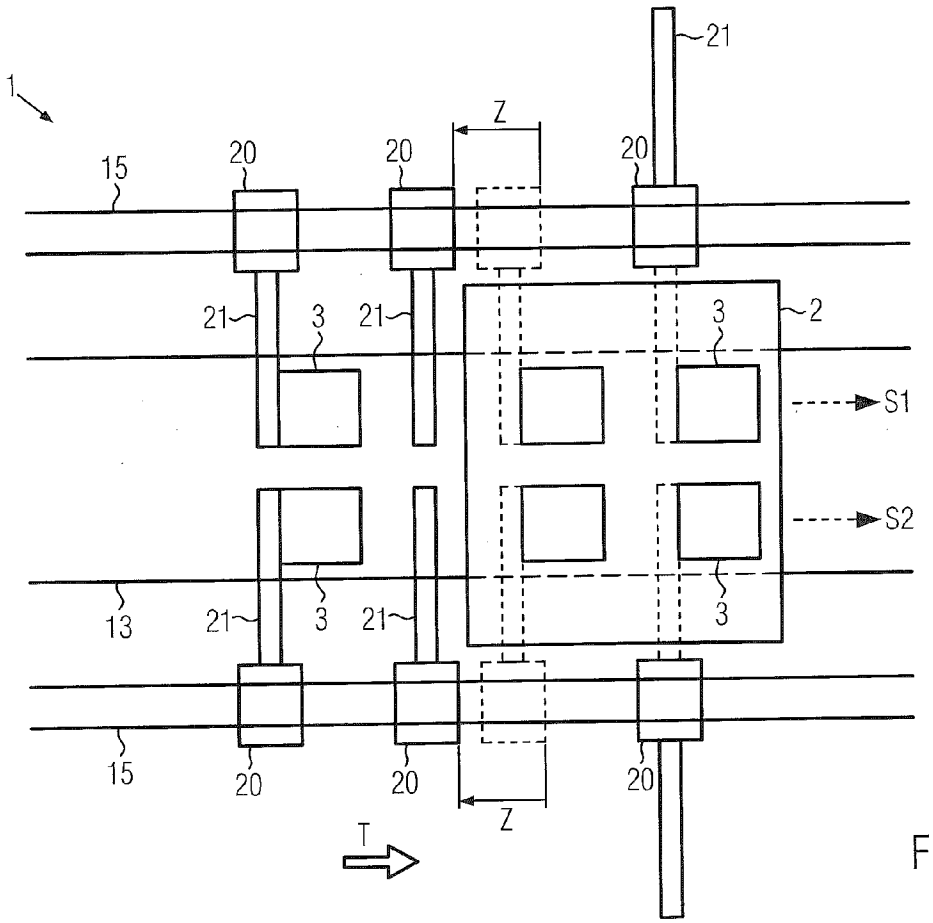
FIG. 7 is a schematic top view of a conveyor system for a tray sealer in accordance with one embodiment of the present invention.

FIG. 7 shows a schematic top view of a further possible variation, which is possible for all the embodiments of the tray sealer 1 according to the present invention allowing, due to the dimensions of the sealing station 2, simultaneous sealing of a plurality of trays 3 arranged in succession in the conveying direction T. In this embodiment, the conveying path 13 comprises two tracks S1, S2. The sealing station 2 and its sealing tool 31 are large enough for holding and sealing a group of four trays simultaneously, i.e. two respective trays 3 on each of the two parallel tracks S1, S2.

The respective pusher paths 15 for the slides 20 having the pushers 21 mounted thereon are located alongside the two tracks S1, S2 according to this embodiment. The pushers 21, when occupying a conveying position, project beyond the conveying path 13 such that each of them takes hold of one tray 3.

As soon as a group of trays 3, for example, four trays 3 according to the present embodiment, has arrived in the sealing station 2, the trays 3 are stopped there. This is done in that, by means of the individual control of the slides 20 along the pusher paths 15, the driving force applied to the slides 20 is terminated. The slides 20 and the pushers 21 of the two trays 3 constituting the rear trays in the conveying direction T can now leave their position, which is indicated by broken lines, and be moved back by a short distance Z until their pushers 21 will be located outside the area of the sealing station 2 and will therefore no longer obstruct a closing movement of the tools 9, 10 of the sealing station 2.

As regards the slides 20 and the pushers 21 of the two front trays 3, this is, however, apparently impossible, since, if they moved back in a direction Z, they would displace the two rear trays 3. According to one embodiment, the pushers 21 are, however, movably mounted on the slides 20 associated therewith. More specifically, the pushers 21 can be configured for moving through the slides 20 linearly and horizontally outwards until they are positioned fully outside the area of the sealing station 2. Alternatively, it would be imaginable that the pushers 21 have a telescopic structural design and are able to reduce their length and/or that they are pivotably mounted on the slides 20 and can thus be removed from the area of the sealing station 2. In this way, none of the pushers 21 will obstruct the sealing tools 9, 10, when the latter closes so as to define the sealing chamber 11.

These possibilities of moving pushers out of a sealing station 2 may also be provided and be of advantage in the case of tray sealers in general, irrespectively of the forms of the conveyor system 14 according to the present invention explained in the present document.

Starting from the above-shown embodiments, the tray sealer 1 according to the present invention and the method according to the present invention can be modified in many respects. For example, it would be imaginable to movably mount the pushers 21 on the associated slides 20 also in the case of single-track tray sealers and conveyor systems 14.

Likewise, it would be imaginable that the sealing station 2 includes for each track S1, S2, S3 a group which comprises a lower tool 9, an upper tool 10 and a sealing tool 31 and which is operable independently of the other tracks. Each of these groups may be provided with a film roll 5 and a residual film winder 8 of its own.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions and methods described above and illustrated in the drawings are presented by way of example only and are not intended to limit the concepts and principles of the present invention. Thus, there has been shown and described several embodiments of a novel invention. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required". Many changes, modifications, variations and other uses and applications of the present construction will, however, become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed is:

1. A tray sealer comprising:

a sealing station for sealing trays with a cover film, the sealing station comprising a lower tool and an upper tool opposing the lower tool, the lower tool and the upper tool disposed for movement relative to each other between an open position and a closed position, the upper tool and the lower tool forming a hermetically sealed sealing chamber in the closed position; and a conveyor system for conveying the trays along a conveying path, the conveyor system including a plurality of pushers each configured for carrying along at least one tray and being movable along an endless pusher path;

wherein the pushers are movable independently of one another along the pusher path; and wherein one or more of the plurality of the pushers are mounted on a respective slide, wherein each of the one or more of the plurality of the pushers are disposed for movement relative the respective slide between a first position and a second position, wherein in the second position, the one or more of the plurality of the pushers are outside an area between the upper tool and the lower tool allowing the upper tool and the lower tool to move to the closed position.

2. The tray sealer according to claim 1, wherein each pusher can be moved along the pusher path with an individual speed profile.

3. The tray sealer according to claim 1, wherein the pusher path comprises a conveying section, associated with the conveying path, and a return section, and wherein the pushers are driven in the return section at a speed which is higher than the speed at which the pushers move on the conveying section.

4. The tray sealer according to claim 1 further comprising at least one linear motor along the pusher path for driving the pushers.

5. The tray sealer according to claim 1 further comprising at least one position sensor for detecting a position of a tray and/or a position of a pusher.

6. The tray sealer according to claim 1 wherein the conveyor path further comprises a buffer section for buffering a plurality of trays along the conveying path.

7. The tray sealer according to claim 1, wherein the conveyor system further comprises a plurality of tracks for conveying a plurality of juxtaposed tracks of trays.

8. The tray sealer according to claim 7, wherein the pushers are driven by a drive system that drives the pushers of different tracks of the conveyor system independently of one another.

9. The tray sealer according to claim 7, wherein the pushers are driven by a drive system that drives some of the pushers on the juxtaposed tracks at the same speed in certain sections along the conveying path.

10. The tray sealer according to claim 1, wherein the conveyor system conveys the trays on a conveyor plane and each of the one or more of the plurality of the pushers are movable relative to the respective slide in a direction substantially parallel to the conveyor plane.

11. The tray sealer according to claim 1, wherein each of the one or more of the plurality of the pushers are movable relative to the respective slide independently of the movement of the respective slide.

12. A method of conveying trays using a conveyor system up to, into and/or from a tray sealer that seals the trays with a cover film, said method comprising the steps of:

moving pushers of the conveyor system along an endless pusher path, wherein the pushers are moved independently of one another along the pusher path;

taking hold of the trays with the pushers;

opening a lower tool and an upper tool opposing the lower tool of a sealing station to define an open area between the upper tool and the lower tool;

conveying the trays along a conveying path into the open area between the upper tool and the lower tool of the sealing station;

moving one or more pushers out of the open area between the upper tool and the lower tool of the sealing station while leaving the conveyed trays in the sealing station; and closing the lower tool and the upper tool of the sealing station to define a hermetically sealed chamber around the trays.

13. The method according to claim 12 further comprising a step of moving the pushers along a return section of the conveyor system at a speed which is higher than the speed at which the pushers are moved along a conveying section of the conveyor system.

14. The method according to claim 12, further comprising a step of conveying the trays along the conveying path on a plurality of juxtaposed tracks.

15. The method according to claim 14, further comprising a step of moving the pushers on one or more of the plurality of juxtaposed tracks at the same speed in certain sections along the conveying path.

16. The method according to claim 12, further comprising a step of selectively moving at least some of the pushers relative to a respective slide, wherein the at least some of the pushers are moveably mounted on the respective slide, to move the at least some of the pushers from the open area between the lower tool and the upper tool of said sealing station prior to the closing the lower tool and the upper tool.

17. The method according to claim 12, wherein the conveying the trays along a conveying path step further comprises conveying the trays on a conveyor plane, and the moving one or more pushers out of the open area between the upper tool and the lower tool step further comprises moving the pushers in a direction substantially parallel to the conveyor plane.

18. The method according to claim 12, wherein the moving one or more pushers out of the open area between the upper tool and the lower tool step further comprises moving the one or more of the pushers relative to the respective slide while the respective slide is not moving.

* * * * *